US009250593B2

(12) United States Patent
Mase et al.

(10) Patent No.: US 9,250,593 B2
(45) Date of Patent: Feb. 2, 2016

(54) IMAGE FORMING APPARATUS AND IMAGE DENSITY CONTROL METHOD EMPLOYED BY THE IMAGE FORMING APPARATUS

(71) Applicants: Ryusuke Mase, Kanagawa (JP); Taichi Urayama, Kanagawa (JP); Tomoko Takahashi, Kanagawa (JP); Shotaro Hoshi, Kanagawa (JP); Ryuji Yoshida, Kanagawa (JP); Hiroyuki Sugiyama, Kanagawa (JP); Masahiko Shakuto, Kanagawa (JP); Hideki Zemba, Kanagawa (JP); Takamasa Ozeki, Kanagawa (JP); Yoshinori Nakagawa, Kanagawa (JP)

(72) Inventors: Ryusuke Mase, Kanagawa (JP); Taichi Urayama, Kanagawa (JP); Tomoko Takahashi, Kanagawa (JP); Shotaro Hoshi, Kanagawa (JP); Ryuji Yoshida, Kanagawa (JP); Hiroyuki Sugiyama, Kanagawa (JP); Masahiko Shakuto, Kanagawa (JP); Hideki Zemba, Kanagawa (JP); Takamasa Ozeki, Kanagawa (JP); Yoshinori Nakagawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/275,038

(22) Filed: May 12, 2014

(65) Prior Publication Data

US 2014/0348521 A1 Nov. 27, 2014

(30) Foreign Application Priority Data

May 21, 2013 (JP) ..... 2013-107017

(51) Int. Cl.
*G03G 15/00* (2006.01)
*G03G 15/08* (2006.01)

(52) U.S. Cl.
CPC ..... *G03G 15/5041* (2013.01); *G03G 15/0848* (2013.01); *G03G 15/5058* (2013.01); *G03G 15/55* (2013.01); *G03G 2215/00042* (2013.01);
(Continued)

(58) Field of Classification Search
CPC ..... G03G 15/5041; G03G 15/5058; G03G 2215/00033; G03G 2215/00037; G03G 2215/00042; G03G 2215/00059; G03G 2215/00063; G03G 2215/0158
USPC ..... 399/46, 49, 72, 301
See application file for complete search history.

(56) References Cited

U.S. PATENT DOCUMENTS

| | | | |
|---|---|---|---|
| 2004/0042822 | A1 | 3/2004 | Fujishiro et al. |
| 2005/0154562 | A1 | 7/2005 | Matsuura et al. |
| 2005/0157327 | A1 | 7/2005 | Shoji et al. |

(Continued)

FOREIGN PATENT DOCUMENTS

| | | |
|---|---|---|
| JP | 2004-184583 | 7/2004 |
| JP | 2005-024612 | 1/2005 |

(Continued)

*Primary Examiner* — Benjamin Schmitt
(74) *Attorney, Agent, or Firm* — Oblon, McClelland, Maier & Neustadt, L.L.P.

(57) ABSTRACT

An image forming apparatus includes a latent image carrier, a charging device, a latent image forming device, a developing device, a transfer device, a toner amount detector, and a control circuit to execute an imaging condition determination process. The control circuit obtains a linear approximation formula of a developing potential and an amount of toner according to an exposure potential of the patch pattern and a detected amount of toner to calculate a developing gamma and a developing start voltage according to a gradient of the linear approximation formula, determines target charging potential, exposure potential and developing bias according to the developing gamma and the developing start voltage, determines an amount of a background potential to be corrected according to a difference between the developing start voltage and a target developing start voltage obtained according to environmental information, and corrects the target charging potential.

12 Claims, 10 Drawing Sheets

(52) U.S. Cl.
CPC ..... *G03G 2215/00059* (2013.01); *G03G 2215/00063* (2013.01)

(56) References Cited

U.S. PATENT DOCUMENTS

| | | | | |
|---|---|---|---|---|
| 2005/0238384 | A1 | 10/2005 | Sampe et al. | |
| 2005/0281596 | A1 | 12/2005 | Nakagawa et al. | |
| 2005/0286916 | A1 | 12/2005 | Nakazato et al. | |
| 2006/0127131 | A1 | 6/2006 | Fujishiro et al. | |
| 2006/0182451 | A1 | 8/2006 | Shoji et al. | |
| 2007/0127934 | A1 | 6/2007 | Shoji et al. | |
| 2008/0003017 | A1 | 1/2008 | Fujishiro et al. | |
| 2009/0052912 | A1 | 2/2009 | Soji et al. | |
| 2010/0040389 | A1* | 2/2010 | Akatsu | 399/48 |
| 2011/0200349 | A1* | 8/2011 | Yoshida et al. | 399/74 |
| 2012/0045235 | A1 | 2/2012 | Shiori et al. | |

FOREIGN PATENT DOCUMENTS

| | | |
|---|---|---|
| JP | 2006-084913 | 3/2006 |
| JP | 2007-286461 | 11/2007 |

* cited by examiner

IMAGE FORMING APPARATUS AND IMAGE DENSITY CONTROL METHOD EMPLOYED BY THE IMAGE FORMING APPARATUS

CROSS-REFERENCE TO RELATED APPLICATION

This patent application is based on and claims priority pursuant to 35 U.S.C. §119 to Japanese Patent Application No. 2013-107017, filed on May 21, 2013, in the Japan Patent Office, the entire disclosure of which is hereby incorporated by reference herein.

BACKGROUND

1. Technical Field

Embodiments of this disclosure generally relate to an electrophotographic image forming apparatus, such as a copier and a printer, and to an image density control method employed by the image forming apparatus.

2. Related Art

Electrophotographic image forming apparatuses usually adjust the density of the images they form at predetermined times to keep image quality stable despite environmental changes over time.

For example, density adjustment control may start with forming a patch pattern on a photoconductor image carrier. The patch pattern is composed of a plurality of patch toner images formed at different electric potentials, that is, different imaging conditions. Then, an amount of toner is detected for each patch toner image of the patch pattern is detected. A linear approximation formula is obtained of a developing potential and an amount of toner according to a detected amount of toner to obtain a developing gamma and a developing start voltage according to a gradient of the linear approximation formula. Target charging potential, exposure potential, and developing bias are determined according to the developing gamma and the developing start voltage thus obtained to adjust a developing bias according to the target developing bias. Accordingly, the image density is kept stable from a highlighted portion to a solid portion.

Some electrophotographic image forming apparatuses employ a contact DC charging method to charge the photoconductor image carriers with a charging roller. The contact DC charging method has an advantage over other charging methods, such as using a scorotron charger and using a contact or non-contact AC charging roller, because of its simple configuration and low production cost. On the other hand, the DC charging method is at a disadvantage compared to the other methods when it comes to evenly charging the latent image carriers because of several factors, such as resistance fluctuation due to roller contamination and fluctuation in the width of an electric discharging area, that is, a contact area between the charging roller and the latent image carrier. Even in the early period of image formation, a rough surface of the charging roller may generate an unevenly charged surface of the latent image carrier, and therefore, the potential is unevenly generated on the surface of the latent image carrier. As a result, a problem called background contamination arises such that the toner may adhere to a background (i.e., unexposed portion) of the latent image carrier.

A larger background potential is effective to prevent such background contamination. The background potential is a difference between a charging potential at the background of the latent image carrier charged and a developing bias applied to develop a latent image (i.e., exposed portion) formed on the latent image carrier with toner. A relatively large background potential may not cause any crucial problem when using a single-component developer without carrier. By contrast, when using a two-component developer including carrier, a relatively large background potential may cause a problem called carrier adhesion such that the carrier particles adhere to the background of the latent image carrier. In short, when using the two-component developer, a relatively small background potential may cause background contamination while a relatively large background potential may cause carrier adhesion.

One approach to preventing carrier adhesion involves using carrier having a relatively large particle diameter and/or high resistance. However, such carrier may cause insufficient development of the latent image formed on the latent image carrier, thereby degrading image quality.

Accordingly, a combination of the contact DC charging method and the two-component developer is typically employed by monochrome image forming apparatuses rather than color image forming apparatuses that prioritize image quality.

However, recent demand for inexpensive color image forming apparatuses capable of forming higher-quality images increases demand for practical use of color image forming apparatuses employing the combination of the contact DC charging method and the two-component developer including low-resistant carrier having a relatively small particle diameter to prevent both background contamination and carrier adhesion.

SUMMARY

In one embodiment of this disclosure, an improved image forming apparatus is described that includes a latent image carrier, a charging device, a latent image forming device, a developing device, a transfer device, a toner amount detector, and a control circuit. The charging device charges the latent image carrier to a predetermined charging potential. The latent image forming device irradiates a charged surface of the latent image carrier to form a latent image thereon. The developing device includes a developer carrier to carry a developer containing at least toner. The developing device transfers the toner carried by the developer carrier onto the latent image formed on the latent image carrier with a developing bias applied to the developer carrier to develop the latent image into a visible toner image. The transfer device includes a transfer member and transfers the toner image from the latent image carrier onto the transfer member. The toner amount detector detects an amount of toner of the toner image formed on the surface of the latent image carrier or the toner image transferred from the latent image carrier to the transfer member per unit area. The control circuit forms a patch pattern including a plurality of patch toner images developed under different imaging conditions, and detects an amount of toner for each of the plurality of patch toner images via the toner amount detector. The control circuit executes an imaging condition determination process at a predetermined time to determine an imaging condition for forming an output image according to a detected amount of toner. The control circuit obtains a linear approximation formula of a developing potential and an amount of toner according to an exposure potential of the patch pattern including the plurality of patch toner images and the detected amount of toner to calculate a developing gamma and a developing start voltage according to a gradient of the linear approximation formula. The control circuit also determines a target charging potential, a target exposure potential and a target developing bias according to the developing gamma and the developing start voltage. The control circuit determines an amount of a background potential to be corrected according to a difference between the developing start voltage and a target developing start voltage obtained according to environmental information. The background potential is a difference between the target charging potential and the target developing bias. Consequently, the control circuit corrects the target charging potential.

In another embodiment of this disclosure, an image density control method employed by the image forming apparatus described above includes forming a patch pattern including a plurality of patch toner images developed under different imaging conditions, detecting an amount of toner of the patch pattern, and controlling image density by adjusting the imaging conditions according to a detected amount of toner. The controlling includes obtaining a linear approximation formula of a developing potential and an amount of toner according to an exposure potential of the patch pattern and the detected amount of toner and calculating a developing gamma and a developing start voltage according to a gradient of the linear approximation formula. The controlling also includes determining a target charging potential, a target exposure potential and a target developing bias according to the developing gamma and the developing start voltage and determining an amount of a background potential to be corrected according to a difference between the developing start voltage and a target developing start voltage obtained according to environmental information. The background potential is a difference between the target charging potential and the target developing bias, and the controlling includes correcting the target charging potential.

BRIEF DESCRIPTION OF THE DRAWINGS

A more complete appreciation of the disclosure and many of the attendant advantages thereof will be more readily obtained as the same becomes better understood by reference to the following detailed description of embodiments when considered in connection with the accompanying drawings, wherein.

Figure 1:
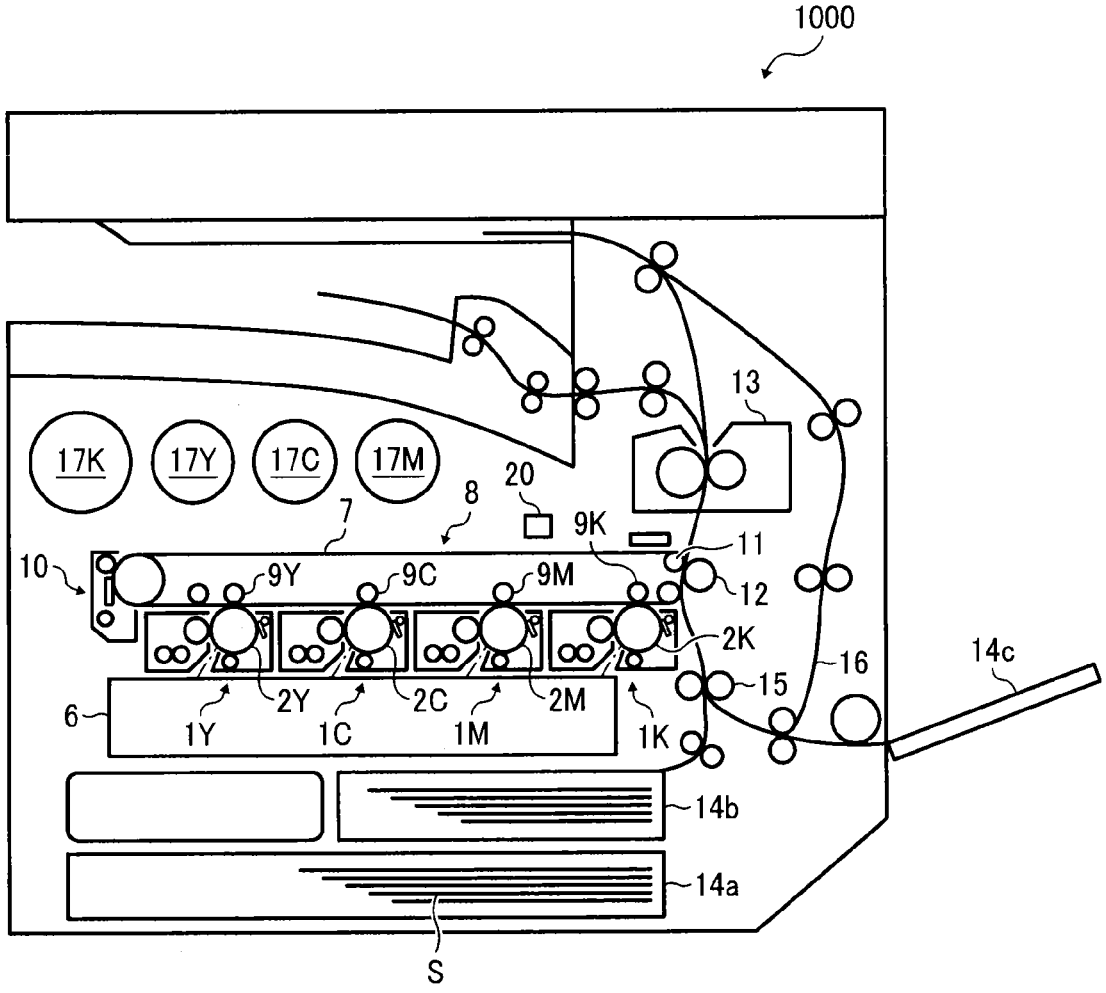
FIG. 1 is a schematic view of an image forming apparatus according to an embodiment of this disclosure.

The accompanying drawings are intended to depict embodiments of this disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the invention and all of the components or elements described in the embodiments of this disclosure are not necessarily indispensable to the present invention.

In a later-described comparative example, embodiment, and exemplary variation, for the sake of simplicity like reference numerals are given to identical or corresponding constituent elements such as parts and materials having the same functions, and redundant descriptions thereof omitted unless otherwise required.

Referring now to the drawings, wherein like reference numerals designate identical or corresponding parts throughout the several views, embodiments of this disclosure are described below.

Initially with reference to FIG. 1, a description is given of an image forming apparatus 1000 according to an embodiment of this disclosure. FIG. 1 is a schematic view of the image forming apparatus 1000. In the present embodiment, the image forming apparatus 1000 is an electrophotographic printer. The image forming apparatus 1000 includes four image forming units 1Y, 1C, 1M and 1K to form toner images of yellow (Y), cyan (C), magenta (M), and black (K), respectively. It is to be noted that, in the following description, suffixes Y, M, C, and Bk denote colors yellow, magenta, cyan, and black, respectively. To simplify the description, these suffixes are omitted unless necessary. In the present embodiment, the four image forming units 1Y, 1C, 1M and 1K are arranged side by side, in that order, from left to right in FIG. 1. Alternatively, the four image forming units 1Y, 1C, 1M and 1K may be arranged side by side in another order.

The image forming units 1Y, 1C, 1M, and 1K have identical configurations, differing only in the color of toner employed. Accordingly, a description is now given of the image forming unit 1Y as a representative example of the image forming units 1Y, 1C, 1M, and 1K, with reference to FIG. 2.

Figure 2:
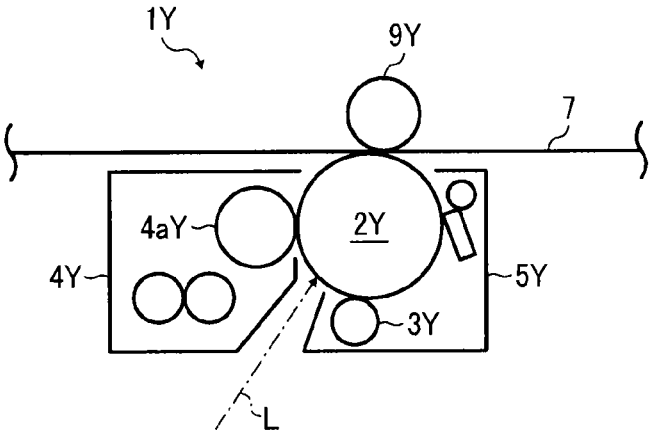
FIG. 2 is a schematic view of an image forming unit incorporated in the image forming apparatus of FIG. 1.

FIG. 2 is a schematic view of the image forming unit 1Y incorporated in the image forming apparatus 1000. The image forming unit 1Y includes a photoconductive drum 2Y serving as a latent image carrier. The photoconductive drum 2Y is surrounded by, e.g., a charging device 3Y, a developing device 4Y, and a cleaning device 5Y. In the present embodiment, the charging device 3Y is a contact DC charging roller. Alternatively, the charging device 3Y may be a contact AC charging roller or a non-contact charging roller. The developing device 4Y contains a two-component developer including toner, in this case of yellow, and magnetic carrier. The two-component developer contains toner having a small particle diameter and low-resistant carrier. Specifically, the toner has a particle diameter of about 4.9 mm to about 5.5 μm, and the carrier has a resistance not greater than about 12.1 Log Ω·cm measured by using an electrical bridge. In addition, the developing device 4Y includes, e.g., a developing roller 4*a*Y, screws to convey and agitate the developer, and a toner density sensor. The developing roller 4*a*Y, serving as a developer carrier, faces the photoconductive drum 2Y. The developing roller 4*a*Y is constructed of a magnet fixed inside and a rotatable sleeve covering the magnet.

The image forming unit 1Y is a process cartridge having components, namely, the photoconductive drum 2Y and the surrounding components such as the charging device 3Y, the developing device 4Y, and the cleaning device 5Y, supported by a common support member as one unit. Accordingly, the image forming unit 1Y is removable from a body of the image forming apparatus 1000, and therefore, consumable parts are replaceable at once at a predetermined time, e.g., when their lifetime ends.

Referring back to FIG. 1, an optical writing unit 6, serving as a latent image forming device, is disposed below the four image forming units 1Y, 1C, 1M, and 1K. The optical writing unit 6 includes, e.g., an optical source, a polygon mirror, an f-θ lens, and a reflection mirror. According to image data, the optical writing unit 6 irradiates surfaces of the photoconductive drums 2Y, 2C, 2M, and 2K with laser light L, as illustrated in FIG. 2, to form electrostatic latent images of yellow, cyan, magenta, and black on the surfaces of the photoconductive drums 2Y, 2C, 2M, and 2K, respectively.

An intermediate transfer unit 8, serving as a transfer device, is disposed above the four image forming unite 1Y, 1C, 1M, and 1K The intermediate transfer unit 8 includes, e.g., a transfer-conveyor belt 7, a plurality of primary transfer rollers 9Y, 9C, 9M, and 9K, a cleaning device 10, a secondary transfer backup roller 11, and a reflection photosensor 20, described later. The intermediate transfer unit 8 transfers a toner image formed in each of the four image forming units 1Y, 1C, 1M, and 1K onto a transfer sheet S, serving as a recording medium, via the transfer-conveyor belt 7. The transfer-conveyor belt 7 is an endless belt stretched around a plurality of rollers. The transfer-conveyor belt 7 rotates in a clockwise direction in FIG. 1 as at least one of the plurality of rollers rotates. The primary transfer rollers 9Y, 9C, 9M, and 9K and the photoconductive drums 2Y, 2C, 2M, and 2K sandwich the transfer-conveyor belt 7 to form primary transfer nips, respectively. The cleaning device 10 includes a brush roller and a cleaning blade. The intermediate transfer unit 8 also includes a secondary transfer roller 12. The secondary transfer roller 12 faces the secondary transfer backup roller 11 at a position downstream of the image forming unit 1K in a direction in which the transfer-conveyor belt 7 rotates. The secondary transfer backup roller 11 and the secondary transfer roller 12 sandwich the transfer-conveyor belt 7 to form a secondary transfer nip.

A fixing unit 13 is disposed above the secondary transfer roller 12. The fixing unit 13 includes a fixing roller and a pressing roller facing each other to form a fixing nip therebetween. The fixing roller incorporates a halogen heater to heat the surface of the fixing roller with power supplied from a power source.

The image forming apparatus 1000 includes, e.g., sheet trays 14*a* and 14*b*, a sheet-feeding roller, and a pair of registration rollers 15 in a bottom portion thereof. The sheet trays 14*a* and 14*b* accommodate a plurality of transfer sheets S, each serving as a recording medium to record an output image. A bypass tray 14*c* is disposed on an external side of the body of the image forming apparatus 1000 to feed the transfer sheet S loaded thereon. The sheet trays 14*a* and 14*b* and the bypass tray 14*c* are hereinafter collectively referred to as trays 14 unless otherwise specified. A duplex unit 16 is disposed on the right side of the intermediate transfer unit 8 and the fixing unit 13 in FIG. 1 to convey the transfer sheet S back to the secondary transfer nip upon duplex printing.

The image forming apparatus 1000 includes toner containers 17Y, 17C, 17M, and 17K in an upper portion thereof to supply toner for the image forming units 1Y, 1C, 1M, and 1K, and more specifically to the developing devices 4Y, 4C, 4M, and 4K, respectively. The image forming apparatus 1000 also includes, e.g., a waste toner bottle and a power unit.

A description is now given of operation of the image forming apparatus 1000.

Firstly, when a power source applies a predetermined voltage to the charging roller, that is, the charging device 3Y, the charging device 3Y charges the surface of the photoconductive drum 2Y, which faces the charging device 3Y. After the surface of the photoconductive drum 2Y is charged and acquires a predetermined electric potential, the optical writing unit 6 irradiates the surface of the photoconductive drum 2Y with the laser light L according to the image data to write an electrostatic latent image on the surface of the photoconductive drum 2Y. When the surface of the photoconductive drum 2Y carrying the electrostatic latent image faces the developing device 4Y, the developing roller 4*a*Y, which faces the photoconductive drum 2Y, supplies toner for the electrostatic latent image written on the surface of the photoconductive drum 2Y to form a visible image, also known as a toner image, in this case of yellow, on the surface of the photoconductive drum 2Y. The toner container 17Y supplies toner for the developing device 3Y according to an output of a toner density sensor.

The four image forming units 1Y, 1C, 1M, and 1K individually perform a series of image forming processes as described above at a predetermined time. Thus, toner images of yellow, cyan, magenta, and black are formed on the surfaces of the photoconductive drums 2Y, 2C, 2M, and 2K. The toner images thus formed are transferred from the respective photoconductive drums 2 onto the transfer-conveyor belt 7 one by one, at the respective primary transfer nip, while being superimposed one atop another. Specifically, the toner images are transferred when the primary transfer rollers 9 are charged to a polarity opposite a polarity of toner attached to the surfaces of the photoconductive drums 2. Thus, a multicolor toner image is formed on the transfer-conveyor belt 7.

The transfer sheet S is conveyed from one of the plurality of sheet trays 14*a* and 14*b* and the bypass tray 14*c* toward the pair of registration rollers 15, which temporarily stops further movement of the transfer sheet S. The transfer sheet S is then conveyed from the pair of registration rollers 15 toward the secondary transfer nip formed between the secondary transfer backup roller 11 and the secondary transfer roller 12 at a predetermined time.

In the fixing nip, and more specifically, between the secondary transfer roller 12 and the transfer-conveyor belt 7, the multicolor toner image is transferred from the transfer-conveyor belt 7 onto the transfer sheet S. Specifically, the multicolor toner image is transferred when the secondary transfer roller 12 is charged to a polarity opposite a polarity of toner attached to an outer surface of the transfer-conveyor belt 7. The transfer sheet S carrying the multicolor toner image is then conveyed from the secondary transfer nip toward the fixing unit 13. In the fixing unit 13, the multicolor toner image is heated by the fixing roller and fixed onto the transfer sheet S. Upon single-sided printing, the transfer sheet S is then discharged outside the image forming apparatus 1000 via conveyor rollers. By contrast, upon duplex printing, the transfer sheet S is then conveyed to the duplex unit 16 via conveyor rollers. The duplex unit 16 reverses the transfer sheet S so that an image is formed, as described above, on a side of the transfer sheet S opposite the side on which an image is previously formed. After the images are formed on both sides of the transfer sheet S, the transfer sheet S is discharged outside the image forming apparatus 1000.

In the image forming apparatus 1000, a patch pattern composed of a plurality of patch toner images is formed on each of the photoconductive drums 2 and transferred onto the transfer-conveyor belt 7 to keep image quality stable despite environmental changes over time.

Then, the reflection photosensor 20, serving as a toner amount detector, detects an amount of toner for each patch toner image of the patch patterns on the transfer-conveyor belt 7. Imaging conditions are controlled according to detected data.

Figure 3:
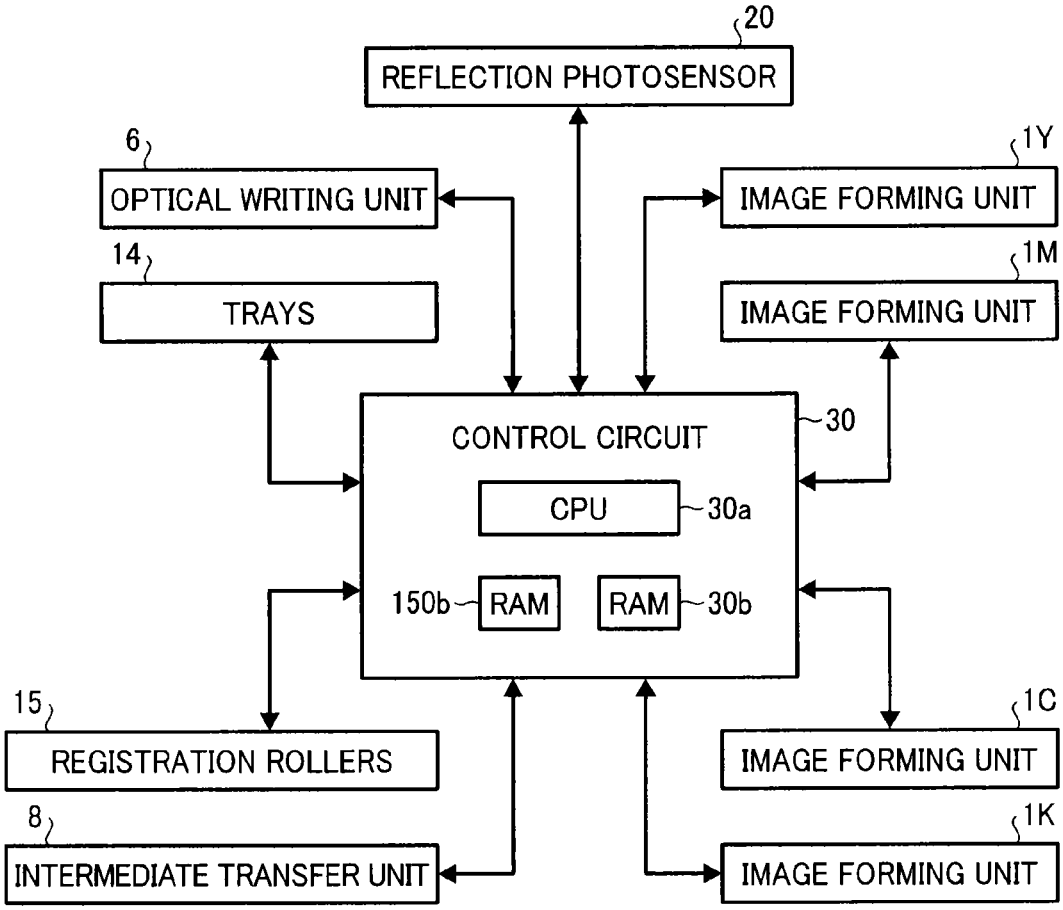
FIG. 3 is a block diagram of an image density control system of the image forming apparatus of FIG. 1.
Figure 4:
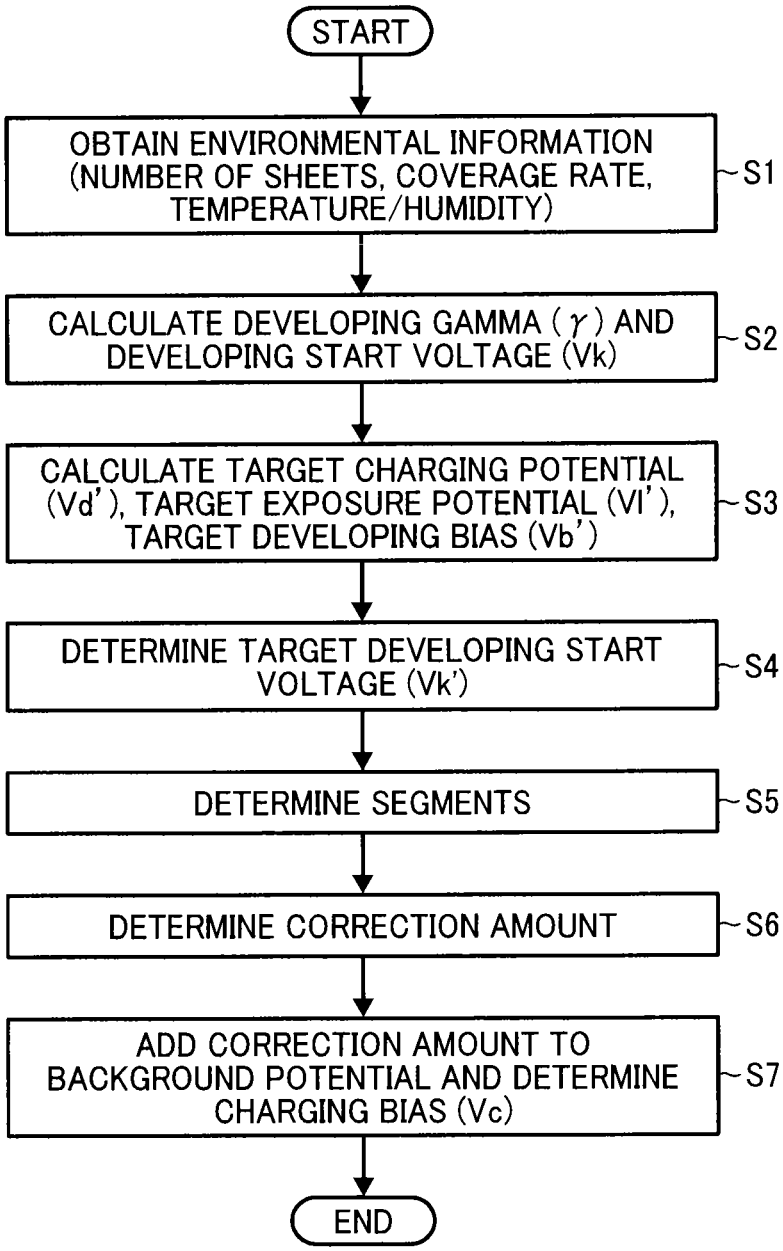
FIG. 4 is a flowchart illustrating an image density control process executed by the image forming apparatus.

Referring now to FIGS. 3 and 4, a description is given of image density control. FIG. 3 is a block diagram of an image density control system of the image forming apparatus 1000 described above. FIG. 4 is a flowchart illustrating the image density control process.

The image forming apparatus 1000 includes a control circuit 30 to execute the image density control. As illustrated in FIG. 3, the control circuit 30 controls various components individually connected to the control circuit 30, such as the image forming units 1Y, 1C, 1M, and 1K, the optical writing unit 6, the trays 14, the pair of registration rollers 15, the intermediate transfer unit 8, and the reflection photosensor 20. The control circuit 30 includes a central processing unit (CPU) 30*a* and a random access memory (RAM) 30*b*.

The reflection photosensor 20 outputs signals corresponding to optical reflectance of the transfer-conveyor belt 7*a* and a patch toner image, described below, formed on the transfer-conveyor belt 7. Typically, reflection photosensors detect diffuse light or regular reflection light to attain a sufficient difference between an amount of light reflected from the outer surface of the transfer-conveyor belt 7 and an amount of light reflected from the patch toner image. The reflection photosensor 20 detects diffusion light to detect a high-density portion of color toner.

The control circuit 30 monitors the performance of the image forming units 1 at certain predetermined times, e.g., when power is turned on, during standby after a predetermined period of time elapses, or during standby after a predetermined number of sheets are outputted from the image forming apparatus 1000. Specifically, as illustrated in FIG. 4, the image density control process starts with obtaining environmental information at the predetermined time (Step S1). The environmental information includes information on, e.g., the number of sheets supplied, sheet coverage rate, temperature, and humidity.

Then, a developing gamma (γ) and a developing start voltage are calculated to obtain developing characteristics of the image forming apparatus 1000 (Step S2). Specifically, the photoconductive drums 2 are evenly charged while rotating. Different from even charging (e.g., −700 V) upon normal printing operation, the photoconductive drums 2 are charged such that an absolute charging potential gradually increases on a negative polarity side. After the photoconductive drums 2 are charged, the optical writing unit 6 irradiates the photoconductive drums 2 with the laser light L to form electrostatic latent images thereon. Then, the developing devices 4 develop the electrostatic latent images with toner to form patch toner images on the photoconductive drums 2, respectively. Upon development, a developing bias is applied to the developing roller 4*a* of each of the developing devices 4 such that an absolute developing bias gradually increases on the negative polarity side.

Figure 5:
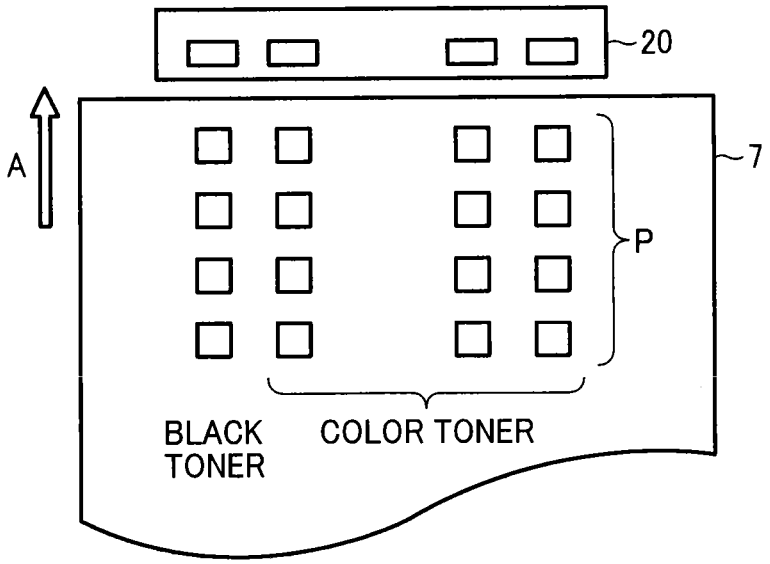
FIG. 5 is an explanatory view of patch patterns formed on a transfer-conveyor belt.

The patch toner images thus formed are transferred onto the transfer-conveyor belt 7 such that the patch toner images are separately arranged side by side thereon as illustrated in FIG. 5, for example. Thus, a patch pattern P each constructed of a plurality of patch toner images is formed on the transfer-conveyor belt 7 for each color of yellow, cyan, magenta, and black. The reflection photosensor 20 detects an amount of light reflected from each patch toner image of the patch patterns P formed on the transfer-conveyor belt 7 when the reflection photosensor 20 faces the patch toner images as the endless transfer-conveyor belt 7 rotates in a direction indicated by arrow A in FIG. 5.

The reflection photosensor 20 then outputs electrical signals corresponding to the detected amount of light to the control circuit 30. The control circuit 30 calculates optical reflectance of each patch toner image according to the signals sequentially outputted from the reflection photosensor 20 to store the calculated optical reflectance in the RAM 30*a* as image density data that shows an amount of toner for each patch toner image. It is to be noted that the cleaning device 10 removes the patch patterns P from the transfer-conveyor belt 7 after the patch patterns P pass through a position where the patch patterns P face the reflection photosensor 20.

Figure 6:
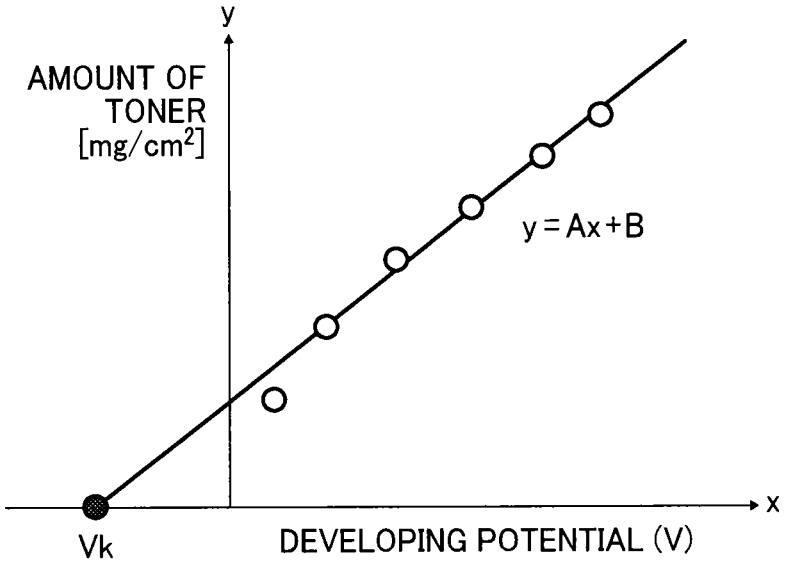
FIG. 6 is a graph of a relation between amount of toner and developing potential.

Then, a linear approximation formula $y=Ax+B$ is calculated according to the image density data stored in the RAM 30*a* and data of exposure potential, that is, latent image potential stored in the RAM 150*b*, and results are shown in a graph as illustrated in FIG. 6. FIG. 6 is a graph of a relation between amount of toner and developing potential. X-axis represents developing potential. The developing potential is obtained by subtracting a developing bias Vb applied from an exposure potential Vl. Y-axis represents an amount of toner attached per unit area. The number of data points plotted in FIG. 6 corresponds to the number of patch toner images. Some data points plotted in the plane is selected for a linear approximation. Then, the linear approximation formula $y=Ax+B$ is obtained by least squares for the data points selected. The developing gamma (γ) and the developing start voltage Vk are calculated according to the linear approximation formula $y=Ax+B$, where A represents a developing gamma (γ), which is a gradient of a straight line that represents the linear approximation formula $y=Ax+B$ in FIG. 6. The developing start voltage Vk is an intercept of the straight line with the x-axis, and obtained by a formula $Vk=-B/A$. Thus, the developing characteristics of the image forming apparatus 1000 are obtained (Step S2).

Then, a target charging potential Vd', a target exposure potential Vl', and a target developing bias Vb' are calculated according to the developing characteristics thus obtained (Step S3). The target charging potential Vd' and the target exposure potential Vl' are determined according to a table showing a predetermined relation between the developing gamma (γ) relative to the charging potential Vd and to the exposure potential Vl. Accordingly, suitable target charging potential Vd' and exposure potential Vl' are selected for the developing gamma (γ). On the other hand, the target developing bias Vb' is determined according to the target charging potential Vd' and the target exposure potential Vl' to attain a developing potential that is calculated according to the developing gamma (γ) and the developing start voltage Vk to attach a maximum amount of toner per unit area. The above-described control is executed for each color of yellow, cyan, magenta, and black.

Figure 7:
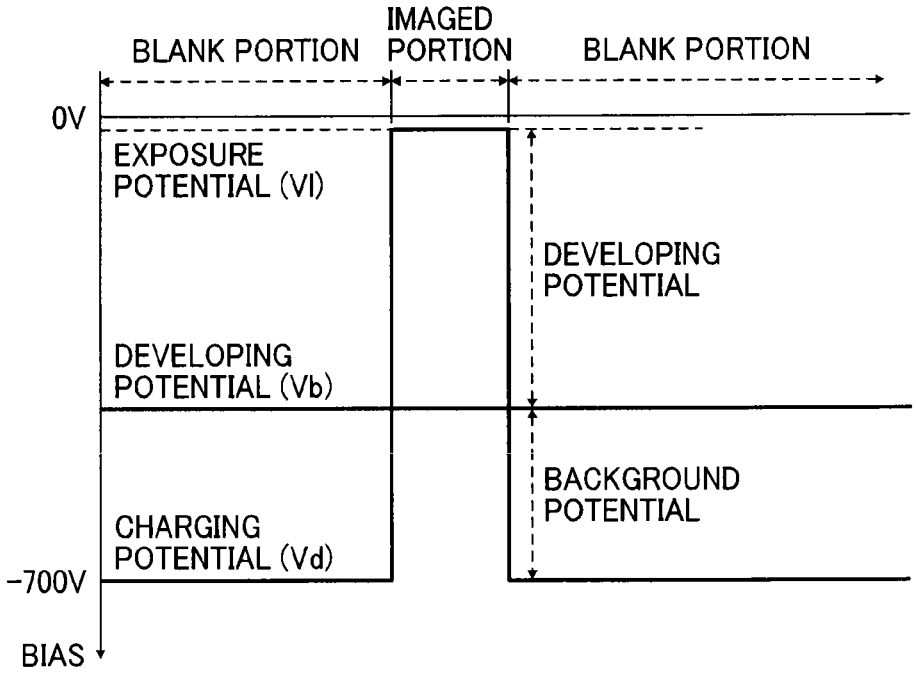
FIG. 7 is a graph illustrating developing potential and background potential.

Referring now to FIG. 7, a description is given of a background potential. FIG. 7 is a graph illustrating developing potential and background potential. The background potential is a difference between the charging potential Vd and the developing bias Vb, and corresponds to a blank portion of image, that is a background portion. The background potential is, e.g., 145 V in this case. A smaller background potential worsens background contamination, while a larger background potential worsens carrier adhesion. Therefore, an appropriate background potential is determined to prevent such background contamination and carrier adhesion.

Figure 8:
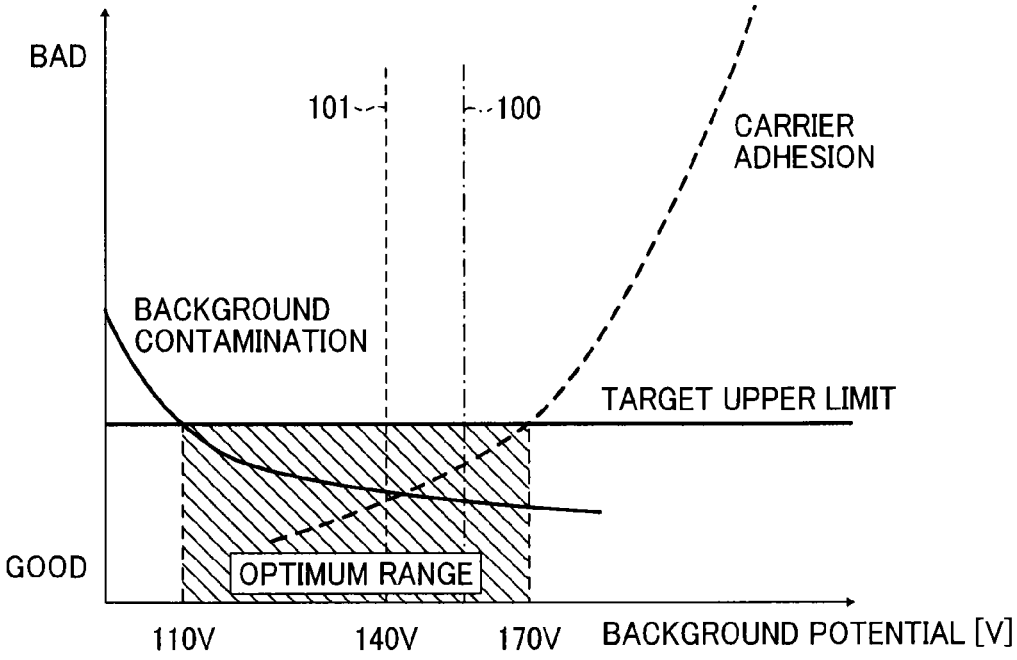
FIG. 8 is a graph of background contamination and carrier adhesion relative to background potential.
Figure 9A:
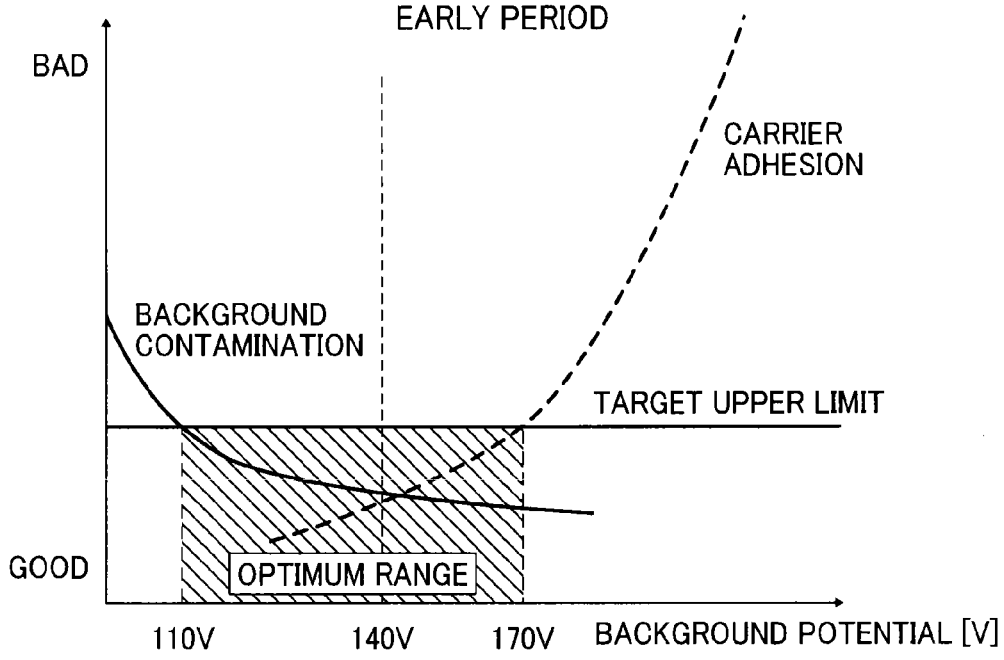
FIG. 9A is a graph of background contamination and carrier adhesion relative to background potential in an early period of image formation.
Figure 9B:
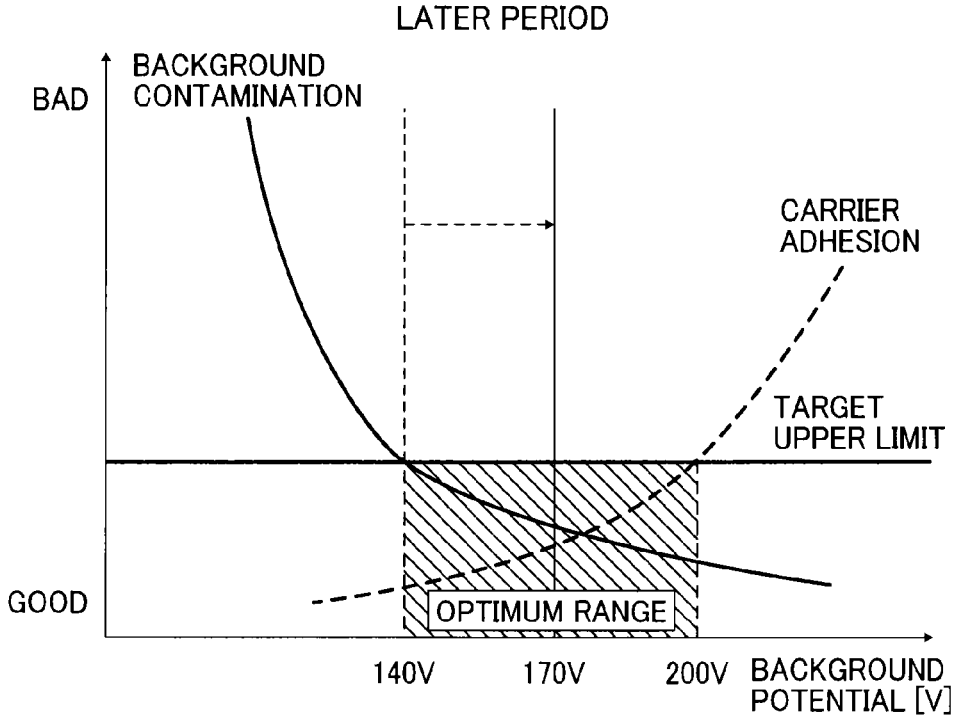
FIG. 9B is a graph of background contamination and carrier adhesion relative to background potential in a later period of image formation.

Referring now to FIGS. 8, 9A and 9B, a description is given of characteristics of background contamination and carrier adhesion relative to background potential.

FIG. 8 is a graph of background contamination and carrier adhesion relative to background potential according to a comparative image density control and the image density control according to the present embodiment. A broken line 100 represents a background potential obtained by the comparative image density control. A broken line 101 represents an optimum background potential. The image density control as in Steps S1 to S3 of FIG. 4 and in FIG. 6 are related to the comparative image density control. As illustrated in FIG. 8, the background potential obtained by the comparative image density control is not always an optimum background potential to prevent background contamination and carrier adhesion. The optimum background potential is shifted to a smaller level. Thus, by the comparative image density control, an optimum background potential may not be obtained due to environmental changes such as temperature and humidity changes and deterioration of the charging roller and carrier over time.

FIGS. 9A and 9B illustrate a change in the background potential over time. FIG. 9A is a graph of background contamination and carrier adhesion relative to background potential in an early period of image formation. FIG. 9B is a graph of background contamination and carrier adhesion relative to background potential in a later period of image formation. As illustrated in FIGS. 9A and 9B, background contamination is worse in the later period of image formation, while carrier adhesion, specifically edge carrier adhesion, is worse in the early period of image formation, due to the behavior of the developer. Therefore, an optimum background potential is shifted to a higher level as the developer is consumed. Generally, a high-temperature, high-humidity environment causes insufficient charge on the toner, thereby worsening background contamination. By contrast, a low-temperature, low-humidity environment worsens carrier adhesion. In the image density control according to the present embodiment, the background potential is shifted to an optimum level depending on the period of image formation and the environment.

An optimum background potential are predetermined by experiments for each condition to suppress background contamination and carrier adhesion under a predetermined upper limit. Accordingly, a certain extent of correction can be made with environmental information such as deterioration of the charging roller and carrier and changes in temperature and humidity. However, accidental errors or factors may change the optimum potential. Meanwhile, the developing start voltage Vk is a voltage with which development of latent images formed on the photoconductive drums 2 starts. Therefore, a background potential lower than the developing start voltage Vk may cause background contamination.

Hence, according to the present embodiment, a target developing start voltage Vk' is determined after Step S3 (Step S4) as illustrated in FIG. 4. The target developing start voltage Vk' and the environmental information are matched by experiments and correlated in a table beforehand. The target developing start voltage Vk' is determined according to a piece of the environmental information initially obtained, with reference to the table. Segments are determined according to the difference between the developing start voltage Vk and the target developing start voltage Vk' (Step S5). Specifically, for example, Segment 1 is a difference not smaller than +400 V. Segment 2 is a difference smaller than +40 V and not smaller than +20 V. Segment 3 is a difference smaller than +20 V and not smaller than 0 V. It is identified to which segment the developing start voltage Vk belongs to determine a correction amount per segment (Step S6). Then, the correction amount determined in Step S5 is added to the background potential calculated according to the charging potential Vd and the developing bias Vb obtained in Step S3 to calculate a target background potential. Finally, a charging bias Vc is determined to attain the target background potential (Step S7).

Figure 10:
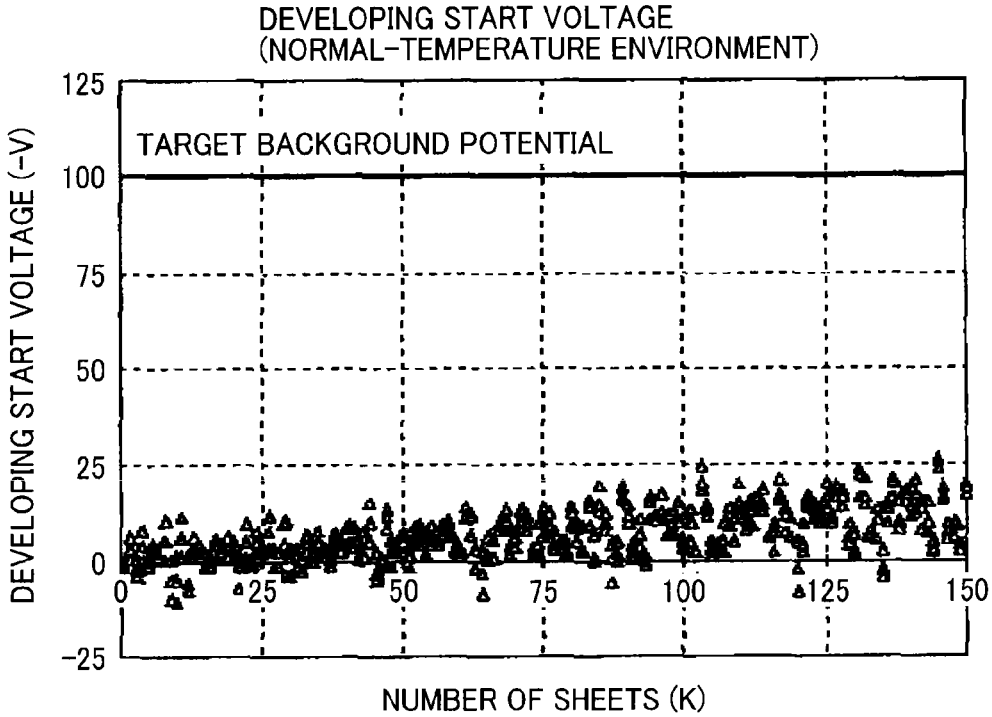
FIG. 10 is a graph of a relation between transition of developing start voltage and target background potential in a normal-temperature environment.

Referring now to FIGS. 10 to 13, a description is given of transition of the developing start voltage Vk and the target background potential. FIG. 10 is a graph of a relation between transition of the developing start voltage Vk and the target background potential when 150,000 sheets are supplied in a normal-temperature environment. FIG. 10 illustrates little changes in the developing start voltage Vk in the normal-temperature environment, regardless of the number of sheets supplied. Accordingly, the background potential is maintained at a certain level.

Figure 11:
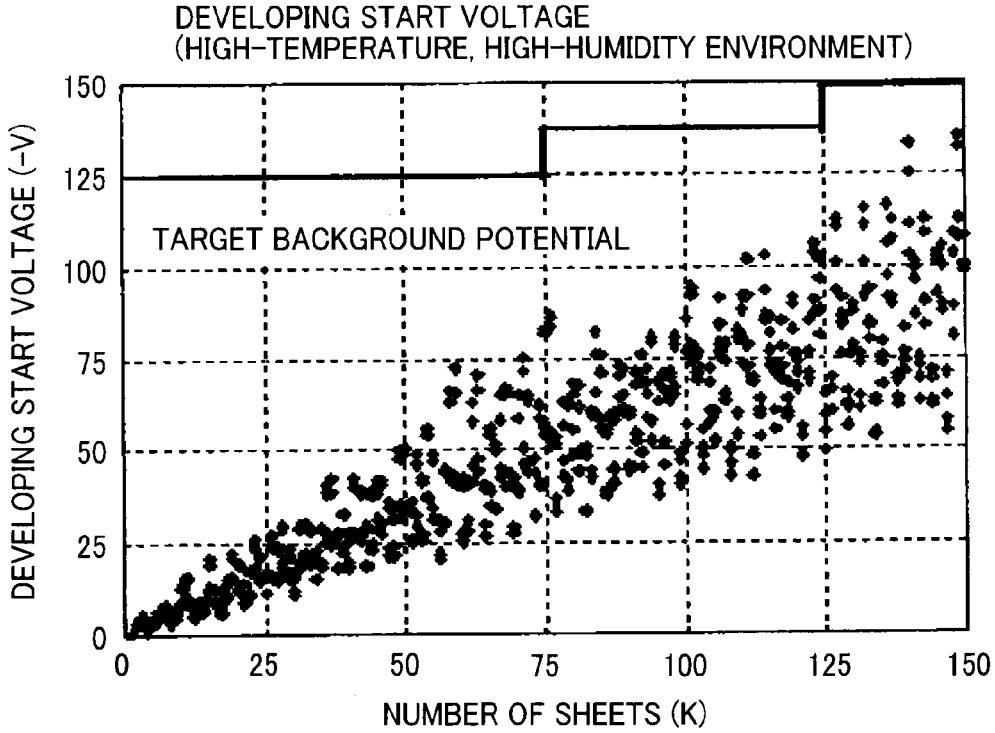
FIG. 11 is a graph of a relation between transition of developing start voltage and target background potential in a high-temperature, high-humidity environment.

FIG. 11 is a graph of a relation between transition of the developing start voltage Vk and the target background potential when 150,000 sheets are supplied in a high-temperature, high-humidity environment. In the high-temperature, high-humidity environment, the developing start voltage Vk exceeds 100 V when over 100,000 sheets are supplied. Accordingly, a normal background potential of 125 V may cause background contamination. Specifically, FIG. 11 shows that some data points are plotted in an area of the developing start voltage Vk of 125 V or larger when over 125,000 sheets are supplied. In other words, the toner may be attached to the background portions of the sheets if the target background potential is maintained at 125 V. Therefore, the background potential is shifted to a higher level. However, the background potential shifted to a higher level in the early period of image formation worsens edge carrier adhesion. Accordingly, the background potential is shifted to a higher level in discrete increments, e.g., when 75,000 sheets are supplied, and when 125,000 sheets are supplied.

Figure 12:
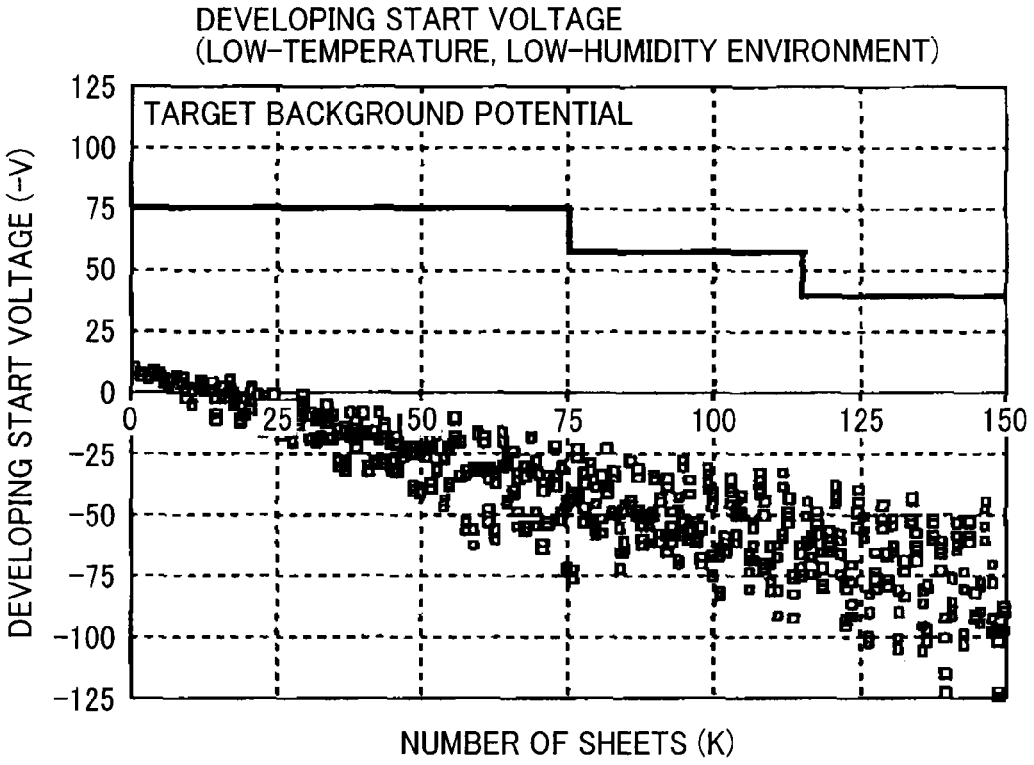
FIG. 12 is a graph of a relation between transition of developing start voltage and target background potential in a low-temperature, low-humidity environment.

FIG. 12 is a graph of a relation between transition of the developing start voltage Vk and the target background potential when 150,000 sheets are supplied in a low-temperature, low-humidity environment. In the low-temperature, low-humidity environment, the developing start voltage Vk is relatively low and background contamination is unlikely to occur. Accordingly, the background potential is shifted to a lower level at which carrier adhesion is also suppressed, in discrete increments, e.g., when 75,000 sheets are supplied, and when 115,000 sheets are supplied.

Figure 13A:
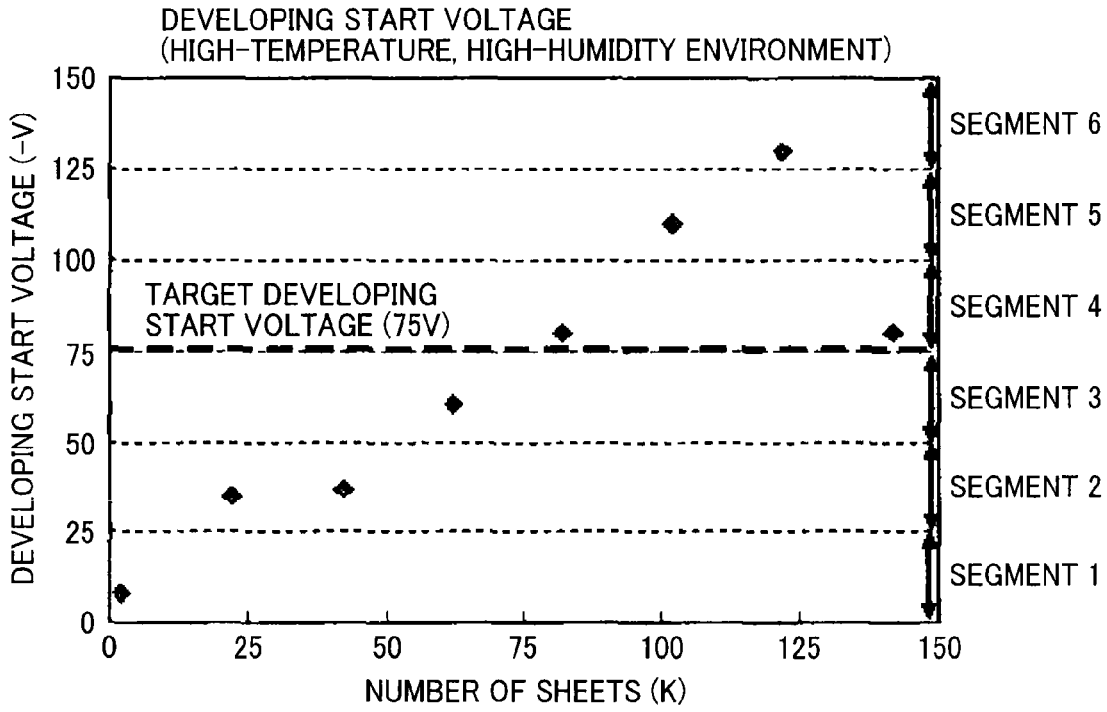
FIG. 13A is a graph of a relation between developing start voltage and the number of sheets supplied in a high-temperature, high-humidity environment, illustrating target developing start voltage.
Figure 13B:
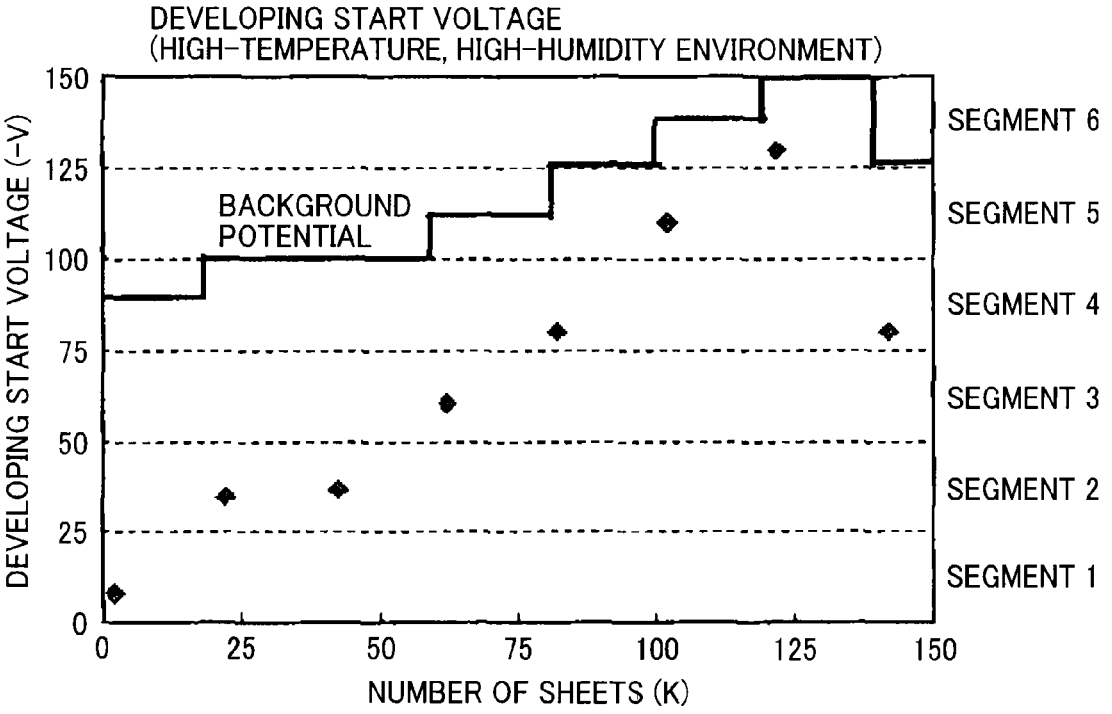
FIG. 13B is a graph of a relation between developing start voltage and the number of sheets supplied in the high-temperature, high-humidity environment, illustrating background potential.

Referring now to FIGS. 13A, 13B, 14A, and 14B, a description is given of segmentation according to the target developing start voltage Vk'. FIG. 13A is a graph of a relation between the developing start voltage Vk and the number of sheets supplied in a high-temperature, high-humidity environment, illustrating the target developing start voltage Vk'. FIG. 13B is a graph of a relation between the developing start voltage Vk and the number of sheets supplied in the high-temperature, high-humidity environment, illustrating the background potential. As illustrated in FIG. 13A, the developing start voltage Vk changes while 150,000 sheets are supplied in the high-temperature, high-humidity environment. The developing start voltage Vk is calculated as needed as illustrated in FIG. 11, while FIG. 13A is a simplified graph.

As described above, the target developing start voltage Vk' is determined according to the environmental information of high-temperature, high-humidity obtained beforehand, with reference to the table of the environmental information and the target developing start voltage Vk'. In the present embodiment, a target developing start voltage Vk' of 75 V is determined. The segments are at intervals of 25 V from the developing start voltage Vk. It is to be noted that the interval of the segments is changeable depending on the environment. According to the present embodiment, the developing start voltage is divided into six segments, and a correction level is determined for each segment as described below. In FIGS. 13A and 13B, the developing start voltage Vk changes from Segment 1 when no sheet is supplied to Segment 6 when 125,000 sheets are supplied. The following correction values are added to a background potential of 119 V calculated before correction to derive target background potentials illustrated in FIG. 13B therefrom:

Segment 1: +31 V;
Segment 2: +18.5 V;
Segment 3: +6 V;
Segment 4: −6 V;
Segment 5: −18.5 V; and
Segment 6: −31 V.

Figure 14A:
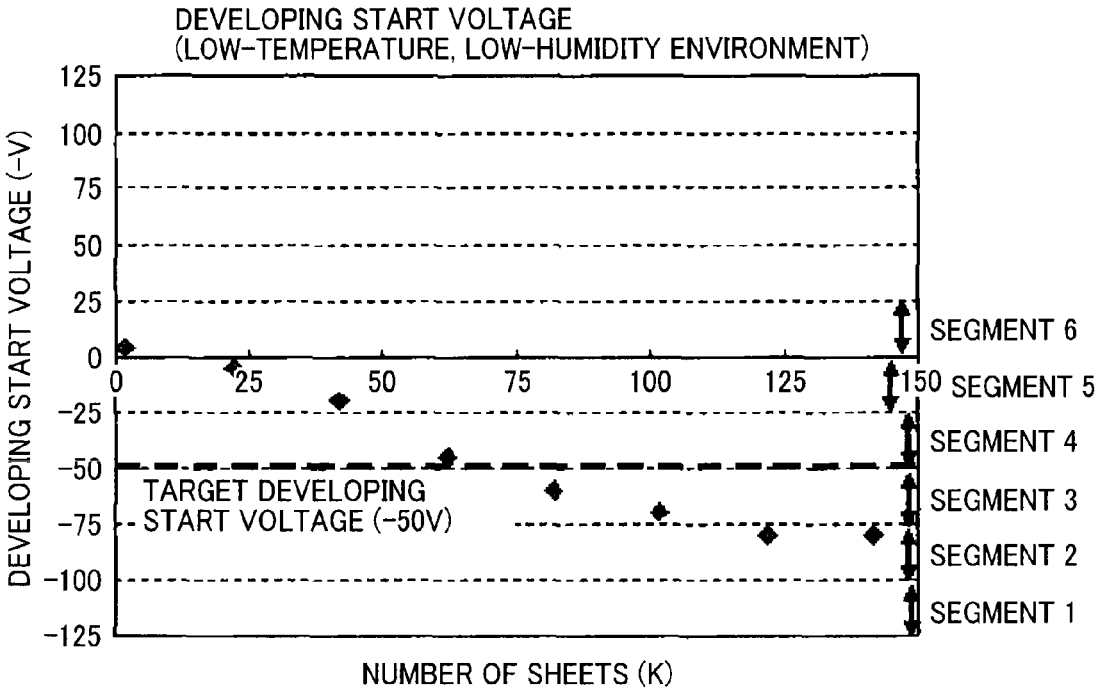
FIG. 14A is a graph of a relation between developing start voltage and the number of sheets supplied in a low-temperature, low-humidity environment, illustrating target developing start voltage.
Figure 14B:
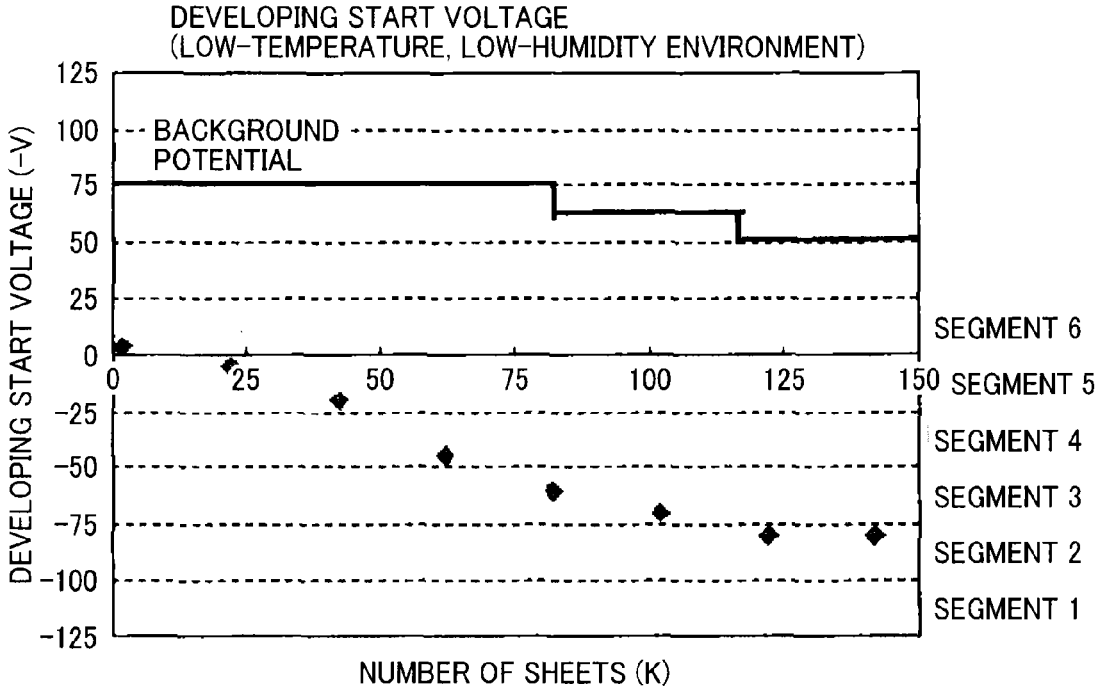
FIG. 14B is a graph of a relation between developing start voltage and the number of sheets supplied in the low-temperature, low-humidity environment, illustrating background potential.

FIG. 14A is a graph of a relation between the developing start voltage Vk and the number of sheets supplied in a low-temperature, low-humidity environment, illustrating the target developing start voltage Vk'. FIG. 14B is a graph of a relation between the developing start voltage Vk and the number of sheets supplied in the low-temperature, low-humidity environment, illustrating the background potential. Unlike the high-temperature, high-humidity environment in which the background potential is raised to prevent background contamination, background contamination is unlikely to occur in the low-temperature, low-humidity environment. Therefore, the image density control is executed mainly to prevent carrier adhesion. Carrier particles are likely to adhere especially to solid images. Therefore, in the low-temperature, low-humidity environment, the background potential is minimized wherever possible.

Accordingly, the target developing start voltage Vk' is determined according to the environmental information of low-temperature, low-humidity obtained beforehand, with reference to the table of the environmental information and the target developing start voltage Vk'. In the present embodiment, a target developing start voltage Vk' of −50 V is determined. The segments are at an interval of 25 V from the target developing start voltage Vk'. It is to be noted that the interval of the segments are changeable depending on the environment. According to the present embodiment, the developing start voltage is divided into six segments, and a correction level is determined for each segment as described below. In FIGS. 14A and 14B, the developing start voltage Vk changes from Segment 6 when no sheet is supplied to Segment 3 when 125,000 sheets are supplied.

Following correction values are added to a background potential of 75 V calculated before correction to derive target background potential illustrated in FIG. 11B therefrom:

Segment 1: 0 V;
Segment 2: 0 V;
Segment 3: 0 V;
Segment 4: −25 V;
Segment 5: −50 V; and
Segment 6: −75 V.

According to the present embodiment, the background potential can be safely minimized wherever possible.

The above-description is given of an embodiment of this disclosure. This disclosure provides effects specific to the individual aspects described below.

According to a first aspect of this disclosure, an image forming apparatus (e.g., image forming apparatus 1000) includes a latent image carrier (e.g., photoconductive drum 2), a charging device (e.g., charging device 3), a latent image forming device (e.g., optical writing unit 6), a developing device (e.g., developing device 4), a transfer device (e.g., an intermediate transfer unit 8), a toner amount detector (e.g., reflection photosensor 20), and a control circuit (e.g., control circuit 30). The charging device charges the latent image carrier to a predetermined charging potential. The latent image forming device irradiates a charged surface of the latent image carrier to form a latent image thereon. The developing device includes a developer carrier (e.g., developing roller 4*a*Y) to carry a developer containing at least toner. The developing device transfers the toner carried by the developer carrier onto the latent image formed on the latent image carrier with a developing bias applied to the developer carrier to develop the latent image into a visible toner image. The transfer device includes a transfer member and transfers the toner image from the latent image carrier onto the transfer member (e.g., transfer-conveyor belt 7). The toner amount detector detects an amount of toner of the toner image formed on the surface of the latent image carrier or the toner image transferred from the latent image carrier to the transfer member per unit area. The control circuit forms a patch pattern (e.g., patch pattern P) including a plurality of patch toner images developed under different imaging conditions, and detects an amount of toner for each of the plurality of patch toner images via the toner amount detector. The control circuit executes an imaging condition determination process at a predetermined time to determine an imaging condition for forming an output image according to a detected amount of toner. The control circuit obtains a linear approximation formula of a developing potential and an amount of toner according to an exposure potential (e.g., exposure potential Vl) of the patch pattern including the plurality of patch toner images and the detected amount of toner to calculate a developing gamma and a developing start voltage (e.g., developing start voltage Vk) according to a gradient of the linear approximation formula. The control circuit also determines a target charging potential (e.g., target charging potential Vd'), a target exposure potential (e.g., target exposure potential Vl') and a target developing bias (e.g., target developing bias Vb') according to the developing gamma and the developing start voltage. The control circuit determines an amount of a background potential to be corrected according to a difference between the developing start voltage and a target developing start voltage (e.g., target developing start voltage Vk') obtained according to environmental information. The background potential is a difference between the target charging potential and the target developing bias. Consequently, the control circuit corrects the target charging potential.

Accordingly, both background contamination and carrier adhesion can be prevented in image forming apparatuses employing a combination of a charging method using a contact DC charging roller and a two-component developer including low-resistant carrier having a relatively small particle diameter.

According to a second aspect of this disclosure, the environmental information used by the control circuit is number of recording media carrying output images.

Accordingly, the correction amount can be determined to attain an appropriate background potential to prevent carrier adhesion from being aggravated over time.

According to a third aspect of this disclosure, the environmental information used by the control circuit is temperature and/or humidity.

Accordingly, the correction amount can be determined to attain an appropriate background potential to prevent background contamination and carrier adhesion against changes in the environment of, e.g., high temperature and high humidity or low temperature and low humidity.

According to a fourth aspect of this disclosure, the control circuit correlates the amount of the background potential to be corrected and the difference between the developing start voltage and the target developing start voltage obtained according to the environmental information.

Accordingly, effective operations enhance printing speed.

According to a fifth aspect of this disclosure, the toner amount detector is an optical sensor that detects diffuse light, which facilitates accurate measurement of the amount of toner of the patch pattern.

According to a sixth aspect of this disclosure, an image density control method includes forming a patch pattern (e.g., patch pattern P) including a plurality of patch toner images developed under different imaging conditions, detecting an amount of toner of the patch pattern, and controlling image density by adjusting the imaging conditions according to a detected amount of toner. The controlling includes obtaining a linear approximation formula of a developing potential and an amount of toner according to an exposure potential (e.g., exposure potential Vl) of the patch pattern and the detected amount of toner and calculating a developing gamma and a developing start voltage (e.g., developing start voltage Vk) according to a gradient of the linear approximation formula (e.g., step S2). The controlling also includes determining a target charging potential (e.g., target charging potential Vd'), a target exposure potential (e.g., target exposure potential Vl') and a target developing bias (e.g., target developing bias Vb') according to the developing gamma and the developing start voltage (e.g., step S3) and determining an amount of a background potential to be corrected according to a difference between the developing start voltage and a target developing start voltage obtained according to environmental information (e.g., steps S5 and S6). The background potential is a difference between the target charging potential and the target developing bias. The controlling includes correcting the target charging potential (e.g., step S7).

Accordingly, both background contamination and carrier adhesion can be prevented in image forming apparatuses employing the combination of the charging method using a contact DC charging roller and the two-component developer including low-resistant carrier having a relatively small particle diameter.

According to a seventh aspect of this disclosure, the controlling uses number of recording media carrying output images as the environmental information.

Accordingly, the correction amount can be determined to attain an appropriate background potential to prevent carrier adhesion from being aggravated over time.

According to an eighth aspect of this disclosure, the controlling uses temperature and/or humidity as the environmental information.

Accordingly, the correction amount can be determined to attain an appropriate background potential to prevent background contamination and carrier adhesion against changes in the environment of, e.g., high temperature and high humidity or low temperature and low humidity.

According to a ninth aspect of this disclosure, the controlling correlates the amount of the background potential to be corrected and the difference between the developing start voltage and the target developing start voltage obtained according to the environmental information.

Accordingly, effective operations enhance printing speed.

According to a tenth aspect of this disclosure, the detecting is executed using an optical sensor that detects diffuse light.

Accordingly, the sensor facilitates accurate measurement of the amount of toner of the patch pattern.

As described above, an image forming apparatus and an image density control method employed by the image forming apparatus according to embodiments of this disclosure prevent both background contamination and carrier adhesion to obtain high-quality image, even if the image forming apparatus employs the combination of the charging method using a contact DC charging roller and the two-component developer including low-resistant carrier having a relatively small particle diameter.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, any of the above-described devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, nonvolatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

What is claimed is:

1. An image forming apparatus comprising:

a latent image carrier;

a charging device to charge the latent image carrier to a predetermined charging potential;

a latent image forming device to irradiate a charged surface of the latent image carrier to form a latent image thereon;

a developing device including a developer carrier to carry a developer containing at least toner, the developing device transferring the toner carried by the developer carrier onto the latent image formed on the latent image carrier with a developing bias applied to the developer carrier to develop the latent image into a visible toner image;

a transfer device including a transfer member to transfer the toner image from the latent image carrier onto the transfer member;

a toner amount detector to detect an amount of toner of the toner image formed on the surface of the latent image carrier or the toner image transferred from the latent image carrier to the transfer member per unit area; and a control circuit to form a patch pattern including a plurality of patch toner images developed under different imaging conditions, to detect an amount of toner for each of the plurality of patch toner images via the toner amount detector, and to execute an imaging condition determination process at a predetermined time to determine an imaging condition for forming an output image according to a detected amount of toner, the control circuit obtaining a linear approximation formula of a developing potential and an amount of toner according to an exposure potential of the patch pattern including the plurality of patch toner images and the detected amount of toner to calculate a developing gamma and a developing start voltage according to a gradient of the linear approximation formula, the control circuit determining a target charging potential, a target exposure potential and a target developing bias according to the developing gamma and the developing start voltage, the control circuit determining a plurality of segments according to a difference between the developing start voltage and a target developing start voltage obtained according to environmental information, the control circuit determining a correction amount by determining which segment of the plurality of segments the developing start voltage belongs, each segment having a respective correction amount, the control circuit determining a background potential which is a difference between the target charging potential and the target developing bias, the control circuit determining a target background potential by adding the correction amount to the background potential, and the control circuit correcting the target charging potential to obtain the target background potential.

2. The image forming apparatus according to claim 1, wherein the environmental information used by the control circuit is a number of recording media carrying output images.

3. The image forming apparatus according to claim 1, wherein the environmental information used by the control circuit is temperature and/or humidity.

4. The image forming apparatus according to claim 1, wherein the control circuit correlates the amount of the background potential to be corrected and the difference between the developing start voltage and the target developing start voltage obtained according to the environmental information.

5. The image forming apparatus according to claim 1, wherein the toner amount detector is an optical sensor that detects diffuse light.

6. The image forming apparatus according to claim 1, wherein the environmental information is humidity and temperature during a number of recording media carrying output images.

7. An image density control method comprising:

forming a patch pattern including a plurality of patch toner images developed under different imaging conditions;

detecting an amount of toner of the patch pattern; and controlling image density by adjusting the imaging conditions according to a detected amount of toner, the controlling including:

obtaining a linear approximation formula of a developing potential and an amount of toner according to an exposure potential of the patch pattern and the detected amount of toner;

calculating a developing gamma and a developing start voltage according to a gradient of the linear approximation formula;

determining a target charging potential, a target exposure potential and a target developing bias according to the developing gamma and the developing start voltage;

determining a plurality of segments according to a difference between the developing start voltage and a target developing start voltage obtained according to environmental information, determining a correction amount by determining which segment of the plurality of segments the developing start voltage belongs, each segment having a respective correction amount, determining a background potential which is a difference between the target charging potential and the target developing bias, determining a target background potential by adding the correction amount to the background potential, and correcting the target charging potential to obtain the target background potential.

8. The image density control method according to claim 7, wherein the controlling uses a number of recording media carrying output images as the environmental information.

9. The image density control method according to claim 7, wherein the controlling uses temperature and/or humidity as the environmental information.

10. The image density control method according to claim 7, wherein the controlling correlates the amount of the background potential to be corrected and the difference between the developing start voltage and the target developing start voltage obtained according to the environmental information.

11. The image density control method according to claim 7, wherein the detecting is executed using an optical sensor that detects diffuse light.

12. The image forming apparatus according to claim 7, wherein the environmental information is humidity and temperature during a number of recording media carrying output images.

* * * * *